US009581379B2

(12) United States Patent
Ikeda et al.

(10) Patent No.: US 9,581,379 B2
(45) Date of Patent: Feb. 28, 2017

(54) FLOOR-STANDING AIR-CONDITIONING APPARATUS

(75) Inventors: Takashi Ikeda, Tokyo (JP); Koji Yamaguchi, Tokyo (JP); Tetsuo Yamashita, Tokyo (JP); Tetsuya Tazawa, Tokyo (JP); Yoshiyuki Nakagawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 187 days.

(21) Appl. No.: 14/387,282

(22) PCT Filed: Apr. 6, 2012

(86) PCT No.: PCT/JP2012/002414

§ 371 (c)(1),
(2), (4) Date: Dec. 23, 2014

(87) PCT Pub. No.: WO2013/150568

PCT Pub. Date: Oct. 10, 2013

(65) Prior Publication Data

US 2015/0211782 A1 Jul. 30, 2015

(51) Int. Cl.
*F25D 23/00* (2006.01)
*F24F 13/30* (2006.01)
(Continued)

(52) U.S. Cl.
CPC ..... *F25D 23/00* (2013.01); *F24F 1/0007* (2013.01); *F24F 1/0025* (2013.01);
(Continued)

(58) Field of Classification Search
CPC ..... F25D 23/00; F25D 21/14; F25D 17/06; F24F 13/22; F24F 1/007; F24F 13/30;
(Continued)

(56) References Cited

U.S. PATENT DOCUMENTS 2,727,455 A 12/1955 Miller et al.
5,044,260 A 9/1991 Avari
6,321,556 B1 * 11/2001 Tesche ..... F24F 1/0007 62/285

FOREIGN PATENT DOCUMENTS

EP 2 835 586 A1 2/2015
JP 53-112168 U 9/1978
(Continued)

OTHER PUBLICATIONS

International Search Report of the International Searching Authority mailed Jun. 12, 2012 for the corresponding international application No. PCT/JP2012/002414 (and English translation).
(Continued)

*Primary Examiner* — Emmanuel Duke
(74) *Attorney, Agent, or Firm* — Posz Law Group, PLC

(57) ABSTRACT

A floor-standing air-conditioning apparatus includes a lower air inlet, an air outlet having an air outlet opening, a heat exchanger that is provided in the body, a crossflow fan that is provided in the body and produces a flow of air in which the air that has flowed into the body passes through the heat exchanger and is guided to the air outlet, a drain pan that is provided below the heat exchanger in the height direction of the body. The heat exchanger includes a front heat exchanger and a rear heat exchanger, a pair of which form a V shape with their lower ends being in contact with, or in proximity to, each other, and are arranged so that the crossflow fan is positioned between the front heat exchanger and the rear heat exchanger.

12 Claims, 3 Drawing Sheets

(51) Int. Cl.

| | |
|---|---|
| ***F24F 1/00*** | (2011.01) |
| ***F24F 13/22*** | (2006.01) |
| ***F25D 17/06*** | (2006.01) |
| ***F25D 21/14*** | (2006.01) |
| *F24F 3/16* | (2006.01) |

(52) U.S. Cl.
CPC ..... *F24F 1/0059* (2013.01); *F24F 3/1603* (2013.01); *F24F 13/22* (2013.01); *F24F 13/30* (2013.01); *F25D 17/06* (2013.01); *F25D 21/14* (2013.01); *F24F 2001/004* (2013.01); *F24F 2003/1682* (2013.01)

(58) Field of Classification Search
CPC .... F24F 2003/1682; F24F 1/0059; F24F 7/10; F24F 3/00; F24F 3/1603; F24F 13/20
See application file for complete search history.

(56) References Cited

FOREIGN PATENT DOCUMENTS

| | | | | |
|---|---|---|---|---|
| JP | 55-041346 | A | | 3/1980 |
| JP | 63-46749 | U | | 3/1988 |
| JP | 64-054168 | A | | 3/1989 |
| JP | 04-273926 | A | | 9/1992 |
| JP | 06-272884 | A | | 9/1994 |
| JP | 07-217987 | A | | 8/1995 |
| JP | 10-264649 | A | | 10/1998 |
| JP | 2000-304413 | A | | 11/2000 |
| JP | 2001-059628 | A | | 3/2001 |
| JP | 2002-206767 | A | | 7/2002 |
| JP | 2004-245482 | A | | 9/2004 |
| JP | 2005-156049 | A | | 6/2005 |
| JP | 2005-156093 | A | | 6/2005 |
| JP | 2007-183015 | A | | 7/2007 |
| JP | 2007-285533 | A | | 11/2007 |
| JP | 2007285533 | A | * | 11/2007 |
| JP | 2007-331739 | A | | 12/2007 |
| JP | 2009186037 | A | * | 8/2009 |
| JP | 2010-025403 | A | | 2/2010 |
| JP | 2010-276246 | A | | 12/2010 |
| JP | 2011-058695 | A | | 3/2011 |
| JP | 2011-237058 | A | | 11/2011 |
| JP | 2011-242076 | A | | 12/2011 |
| JP | 2012-083038 | A | | 4/2012 |

OTHER PUBLICATIONS

Office Action issued Dec. 3, 2015 in the corresponding NZ application No. 700976.
Extended European Search Report dated Feb. 3, 2016 issued in corresponding EP patent application No. 12873781.4.
Office Action mailed Apr. 21, 2015 in corresponding JP application No. 2014-508922 (English translation attached).
Office Action dated May 4, 2016 issued in corresponding NZ patent application No. 700976.

* cited by examiner

FLOOR-STANDING AIR-CONDITIONING APPARATUS

CROSS REFERENCE TO RELATED APPLICATION

This application is a U.S. national stage application of PCT/JP2012/002414 filed on Apr. 6, 2012, the contents of which are incorporated herein by reference.

TECHNICAL FIELD

The present invention relates to a floor-standing air-conditioning apparatus.

BACKGROUND ART

In one example, a floor-standing air-conditioning apparatus (an indoor unit) that is installed on the floor of a room or on any other like place has an air outlet, from which conditioned air is fed, in the upper portion of its body in the height direction. In an example of such a known floor-standing air-conditioning apparatus, a flat-plate-like heat exchanger is provided obliquely such that the upper portion of the heat exchanger is inclined toward the front side of the body and the lower portion of the heat exchanger is inclined toward the rear side of the body. Furthermore, the pitch of an air inlet grill is narrower in its areas closer to the center of rotation of a fan, that is, is wider in its areas farther from the center of rotation of the fan (see, for example, Patent Literature 1).

In another example, a drain pan provided below a heat exchanger is formed integrally with a cabinet. An air outlet is provided in the upper portion of the cabinet. The heat exchanger has a plate shape and is inclined downward such that the front side thereof faces toward the floor surface. An air inlet is provided below the air outlet. The air inlet is inclined downward so as to face toward the floor. A fan is provided at a position higher than a half of the height of the cabinet (see, for example, Patent Literature 2).

In another air-conditioning apparatus, a fan is provided in an upper portion of the unit. A V-shaped heat exchanger is provided below the fan. An air outlet and an air inlet are provided in the upper front portion and in the lower portion, respectively, of the unit (see, for example, Patent Literature 3).

CITATION LIST

Patent Literature

Patent Literature 1: Japanese Unexamined Patent Application Publication No. 2011-058695 (p. 3, and FIGS. 1 and 2)

Patent Literature 2: Japanese Unexamined Patent Application Publication No. 2011-237058 (p. 4 and FIG. 1)

Patent Literature 3: Japanese Unexamined Patent Application Publication No. 6-272884 (p. 5 and FIG. 2)

SUMMARY OF INVENTION

Technical Problem

In the air-conditioning apparatus disclosed in Patent Literature 1, for example, the flat-plate-like heat exchanger is inclined. Therefore, for example, to reliably provide a satisfactory heat exchange area so as to increase the capacity, the body of the air-conditioning apparatus is long in the height direction. Accordingly, the size of the air-conditioning apparatus is large. Hence, if the floor-standing air-conditioning apparatus is installed in a space below a bay window or a high window as in a typical case, the air-conditioning apparatus may cover the window. That is, a limitation for installation is imposed, reducing the ease of construction.

The air-conditioning apparatus disclosed in Patent Literature 2 has, for example, the following problems.

(1) The plate-like heat exchanger is inclined, and the rear side of the cabinet, which forms a wall of an air passage extending from the heat exchanger to the fan, is long. Therefore, cold air is condensed on the wall surface because the cold air comes into contact with the rear surface of the cabinet or because the flow of the cold air is unstable. Hence, a dew-collecting passage needs to be provided separately.

(2) The air inlet is provided below the air outlet. The air inlet is inclined downward so as to face toward the floor. The fan is provided at a position higher than a half of the height of the cabinet. Therefore, air near the floor is easily taken in, and an ascending air current can easily be produced. However, simply providing the fan in the upper portion of the cabinet is not enough. Since the fan has a heavy weight and rotates, the body of the air-conditioning apparatus is often shaken due to vibrations or the like and swings unstably. Hence, if the rear side of the body of the air-conditioning apparatus is not fixed, the air-conditioning apparatus may fall or high noise may be generated due to the swing.

Meanwhile, the air-conditioning apparatus disclosed in Patent Literature 3 has, for example, the air outlet in the upper front portion of the unit and is incapable of blowing air upward. Therefore, if the air-conditioning apparatus is simply used as a floor-standing apparatus, it is not possible in heating to, for example, circulate air through the entire room by blowing air upwards. Moreover, humans may feel uncomfortable as air blown frontwards directly strikes their bodies.

The present invention has been made to solve the above problems and provides a stable floor-standing air-conditioning apparatus having an increased capacity with respect to the size of the body thereof.

Solution to Problem

A floor-standing air-conditioning apparatus according to the present invention includes a lower air inlet having an air inlet opening configured to allow air to flow into a body from the lower portion of the body on the side of its front face, an air outlet having an air outlet opening configured to allow air in the body to flow out of the body and rise, a heat exchanger that is provided in the body and configured to condition air, a crossflow fan that is provided in the body and configured to produce a flow of air in which the air that has flowed into the body passes through the heat exchanger and is guided to the air outlet, a drain pan that is provided below the heat exchanger in a height direction of the body and configured to receive water generated by dew condensation, and a lower diffuser provided in a lower portion of the air outlet in the body so as not to be oriented toward the air outlet. The crossflow fan is provided at a position below the air outlet in the height direction of the body and on a side of rear face with respect to a center of the body in a depth direction. The heat exchanger includes a front heat exchanger provided on the side of the front face and a rear heat exchanger provided on the side of rear face, a pair of which form a V shape with their lower ends being in contact with each other, and are arranged so that the crossflow fan is positioned between the front heat exchanger and the rear heat exchanger.

Advantageous Effects of Invention

In the floor-standing air-conditioning apparatus according to the present invention, the crossflow fan is provided on the rear side of the unit. Therefore, falling toward the front side can be prevented and the apparatus can stably be placed on the floor. Furthermore, since the apparatus can stably be set, vibrations due to driving of the fan during the operation can be reduced to, in turn, reduce, for example, noise generated by the vibrations transmitted into the room. Furthermore, since the heat exchanger includes the front heat exchanger and the rear heat exchanger, a pair of which form a V shape, the heat exchange performance can be increased by increasing the heat exchange area while the height of the body is kept low, as compared to the case where a flat-plate-like heat exchanger is provided. Thus, energy can be saved. Furthermore, the taken air can be split by the drain pan so as to flow into the front heat exchanger and into the rear heat exchanger. Therefore, the drift of air can be suppressed, and the distribution of the amount of air taken into the fan can be uniformed. Thus, noise can be reduced. Furthermore, the torque of a fan motor can be reduced to save energy.

DESCRIPTION OF EMBODIMENTS

Embodiment 1

An air-conditioning apparatus according to Embodiment 1 of the present invention will now be described with reference to the drawings.

Figure 1:
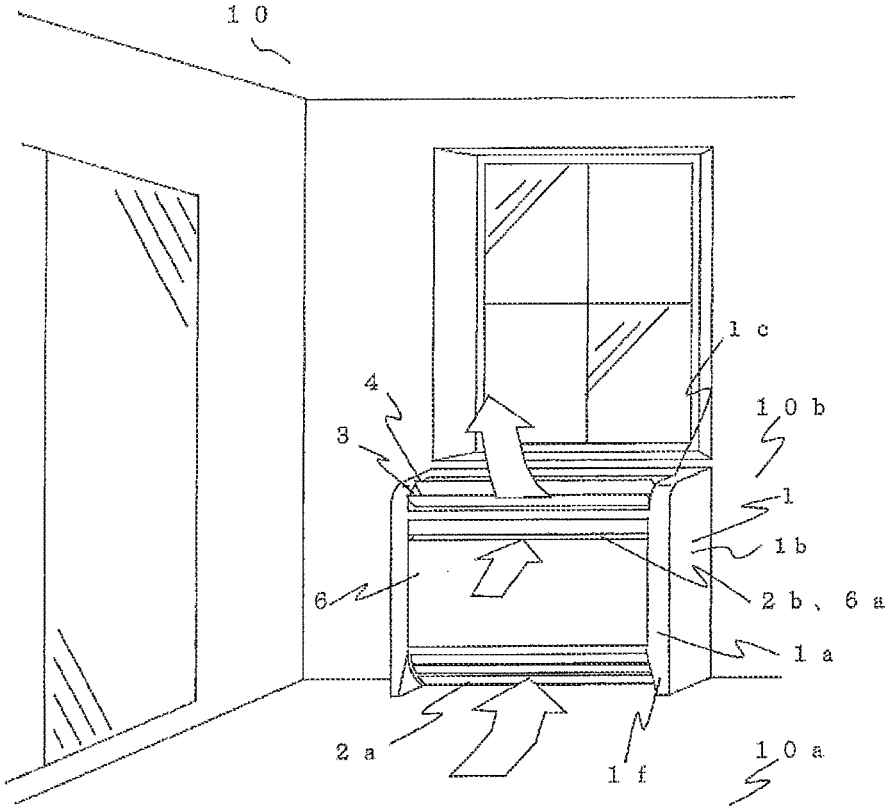
FIG. 1 is a diagram illustrating an outline of installation of a floor-standing air-conditioning apparatus according to Embodiment 1 of the present invention.
Figure 2:
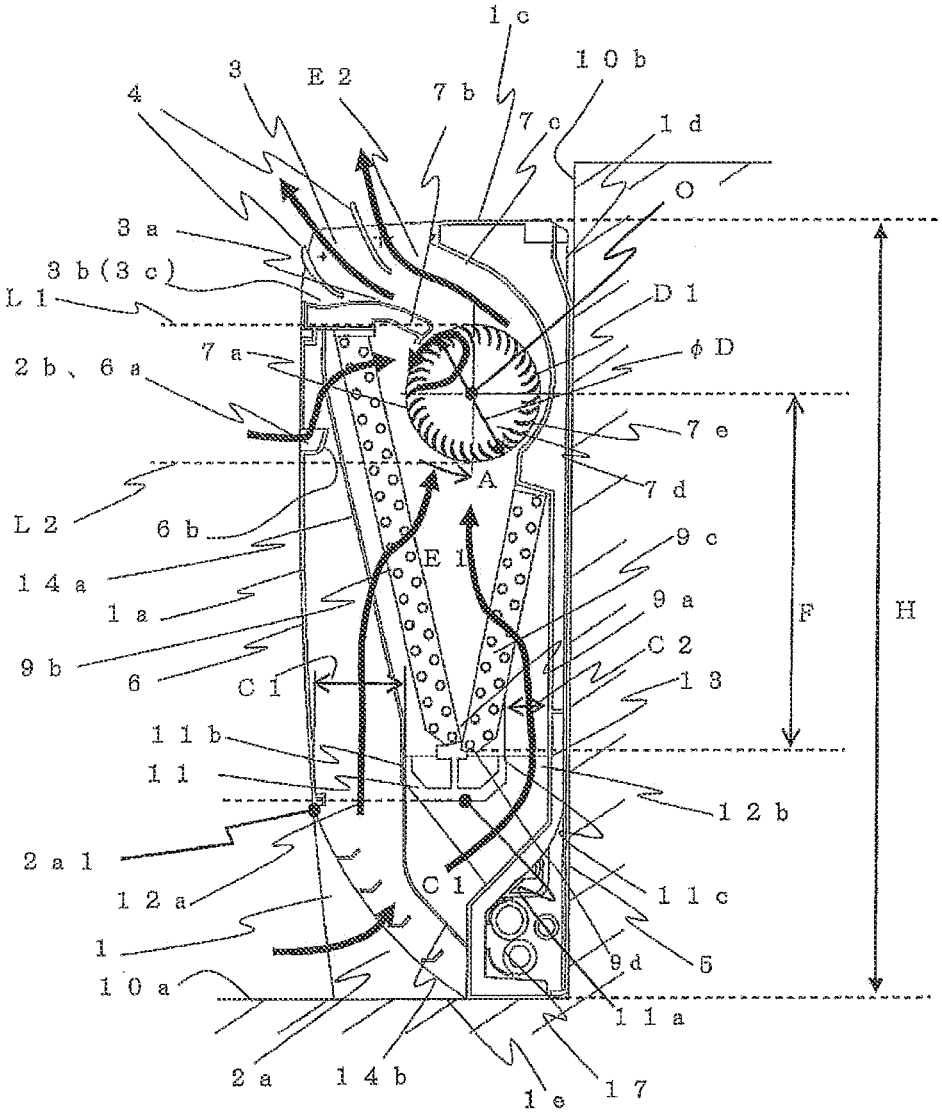
FIG. 2 is a vertical sectional view of the air-conditioning apparatus according to Embodiment 1 of the present invention.

FIG. 1 is a diagram illustrating an outline of installation of a floor-standing air-conditioning apparatus according to Embodiment 1 of the present invention that is seen in a room. FIG. 2 is a vertical sectional view of the body of the air-conditioning apparatus according to Embodiment 1 of the present invention in a vertical cross-section perpendicular to the rotational axis of a crossflow fan and near the substantial center in the horizontal direction in front view.

As illustrated in FIG. 1, an air-conditioning-apparatus body 1 has a rectangular parallelepiped shape that is horizontally elongated in front view. The air-conditioning-apparatus body 1 is placed on a floor 10*a*, and a rear attaching plate 5 that covers a body rear face 1*d* of the air-conditioning-apparatus body 1 is fixed to a wall 10*b* of a room 10. The air-conditioning-apparatus body 1 includes an air outlet 3 having an air outlet opening that opens from the upper portion of a body front face (the front face of the body) 1*a* to a body upper face 1*c*. The air outlet 3 is provided with air vanes 4 that control the flow of air blown from the inside of the air-conditioning-apparatus body 1. The air-conditioning-apparatus body 1 also includes a lower air inlet 2*a* provided in the lower portion of a front panel 6 on its own body front face 1*a*. The lower air inlet 2*a* has an air inlet opening that opens to a lower face 1*e* of the air-conditioning-apparatus body 1 so as to face the floor 10*a*. Frames 1*f* are provided at the two respective ends of the air-conditioning-apparatus body 1 so as to form an arch. The body front face 1*a* has a front air inlet 2*b* at a position below the air outlet 3 and above the lower air inlet 2*a*. Hereinafter, the lower air inlet 2*a*, the front air inlet 2*b*, and the like will be collectively referred to as air inlets 2, unless otherwise specified. The front panel 6 is a flat panel having only a few (no) grating bars. Hence, dust and the like can easily be removed from the front panel 6, even if any such dirt adheres to it. Moreover, since the inside of the air-conditioning-apparatus body 1 cannot be seen, properties of design can be improved.

Referring to FIG. 2, a crossflow fan 7 serves as an air-sending device that produces a flow of air from the air inlet 2 toward the air outlet 3. In the air-conditioning-apparatus body 1, the crossflow fan 7 extends in the direction in which the air-conditioning-apparatus body 1 is horizontally elongated. The crossflow fan 7, together with a fan motor (not illustrated) connected to the longitudinal end of an impeller 7*a*, is provided in the height direction at a position that is on the side of the body rear face 1*d* in the depth direction of the air-conditioning-apparatus body 1 above the air-conditioning-apparatus body 1 and below the air outlet 3. The crossflow fan 7 includes the impeller 7*a*, a stabilizer 7*b*, a guide wall 7*c*, rings 7*d*, and blades 7*e*. The impeller 7*a* includes a plurality of impeller portions that are connected and fixed to one another. The impeller portions each have a comb shape and include a plurality of blades 7*e* extending from a corresponding one of the rings 7*d* having a disk shape. The stabilizer 7*b* separates an inlet-side air passage E1 and an outlet-side air passage E2 from each other and stabilizes the circular vortex of air produced in the fan. The guide wall 7*c* having a curled shape is provided on the outlet side of the impeller 7*a* that is opposite the stabilizer 7*b*. The guide wall 7*c* guides the flow of air produced upon the rotation of the impeller 7*a* toward the air outlet 3.

A heat exchanger 9 includes a front heat exchanger 9*b* and a rear heat exchanger 9*c*. The front heat exchanger 9*b* is positioned on the front side (on the side of the body front face 1*a*) with respect to the crossflow fan 7 in the air-conditioning-apparatus body 1. The rear heat exchanger 9*c* is positioned on the rear side (on the side of the body rear face 1*d*) with respect to the crossflow fan 7 in the air-conditioning-apparatus body 1. The front heat exchanger 9*b* and the rear heat exchanger 9*c* are in contact with or close to each other at the respective lower ends thereof, thereby forming a V-shaped projection 9*a*. That is, the front heat exchanger 9*b* and the rear heat exchanger 9*c* are arranged in a substantially normal V shape with the crossflow fan 7 positioned between them. In the heat exchanger 9 according to Embodiment 1, the front heat exchanger 9*b* has a larger area that allows passage of air than the rear heat exchanger 9*c*.

A drain pan 11 receives and temporarily stores condensed water generated by the heat exchanger 9. The drain pan 11 is provided below the V-shaped projection 9*a* of the heat exchanger 9 and has a concave shape that covers the V-shaped projection 9*a*. To allow air to flow into the front heat exchanger 9*b* and into the rear heat exchanger 9*c*, a front air passage opening 12*a* is provided between a drain-pan front side wall 11*b* of the drain pan 11 and the front panel 6 in the depth direction of the air-conditioning apparatus, and a rear air passage opening 12*b* is provided between a drain-pan rear side wall 11*c* of the drain pan 11 and a rear air passage wall 13 of the air-conditioning-apparatus body 1. A shortest distance C1 between the drain-pan front side wall 11*b* and the front panel 6 that corresponds to the shortest opening size of the front air passage opening 12*a* and a shortest distance C2 between the drain-pan rear side wall 11*c* and the rear air passage wall 13 that corresponds to the shortest opening size of the rear air passage opening 12*b* satisfy a relation C1>C2. To obtain this relation, the area of the air passage on the front side is made larger.

The height (vertical dimension) of the air-conditioning-apparatus body 1 is defined as an air-conditioning-apparatus-body height H. Also, the vertical distance between a fan axis of rotation center O defined on the impeller 7*a* of the crossflow fan 7 and a lower end 9*d* of the heat exchanger 9 is defined as a vertical distance F. The outside diameter of the crossflow fan 7 (impeller 7*a*) is defined as a fan outside diameter D. In Embodiment 1, the vertical distance F, the fan outside diameter D, and the air-conditioning-apparatus-body height H are 280 mm, 115 mm, and 600 mm, respectively. In this case, the vertical distance F is about 2.4 times the fan outside diameter D. Preferably, the vertical distance F is equal to or smaller than the product of the fan outside diameter D multiplied by four. This is for the following reason. If the extreme lower end of the heat exchanger 9 and the crossflow fan 7 are too far from each other, the air does not reach the extreme lower end, failing in heat exchange in that case. Consequently, the heat exchange efficiency is reduced.

Regarding the air inlet 2, the position of the lower air inlet 2*a* is determined such that, in a state where, for example, the air-conditioning apparatus is installed in a room, the heat exchanger 9 and the drain pan 11 cannot be seen through the lower air inlet 2*a* when the air-conditioning-apparatus body 1 is seen from the front or obliquely. Hence, in Embodiment 1, an upper end position 2*a*1 of the lower air inlet 2*a* is below a drain-pan lower end 11*a*.

The front air inlet 2*b* is provided in the front panel 6 so as to open to the exterior across the interval, in the height direction of the air-conditioning-apparatus body 1, between two horizontal tangent lines L1 and L2 that are tangent to a circle D1 defining the fan perimeter.

Therefore, the open portion of the front air inlet 2*b* in the height direction is positioned between the upper and lower ends of the impeller 7*a* of the crossflow fan 7. The front air inlet 2*b* is provided with an air-guiding wall 6*b*. The air-guiding wall 6*b* first extends substantially horizontally from the lower portion of a front-panel opening 6*a*, then curves upward, and further extends along the front panel 6 so as to have a substantially L shape. In the air outlet 3, a lower diffuser 3*a* that forms an air-outlet lower portion of the stabilizer 7*b* extends horizontally, and a downstream-side end 3*b* has an arc-shaped recess 3*c*.

A filter 14 removes dust and the like from air that flows from the lower air inlet 2*a* into the air-conditioning-apparatus body 1. The filter 14 includes a front-heat-exchanger-side filter 14*a* and a rear-heat-exchanger-side filter 14*b* that are separate from each other and provided in the respective air passages to the front heat exchanger 9*b* and to the rear heat exchanger 9*c*. In Embodiment 1, the rear-heat-exchanger-side filter 14*b* has a higher collection efficiency than the front-heat-exchanger-side filter 14*a*. By providing constituent devices in the air-conditioning-apparatus body 1 as described above, the center of gravity of the air-conditioning apparatus is defined at least near the center in the depth direction of the air-conditioning apparatus, forming a stable arrangement.

The operation of the floor-standing air-conditioning apparatus configured as described above will now be described on the basis of the flow of air. As illustrated in FIG. 2, when the fan motor is driven and the impeller 7*a* of the crossflow fan 7 rotates about the fan axis of rotation center O in the direction in which the fan rotates (a direction represented by arrow A), air in the room 10 flows into the air-conditioning-apparatus body 1 from the lower air inlet 2*a* and the front air inlet 2*b*. The air thus flowed in is cleaned by the filter 14 and is split by the drain pan 11 into a flow of air on the side of the front air passage opening 12*a* and a flow of air on the side of the rear air passage opening 12*b*. The flows of air individually pass through the front heat exchanger 9*b* and the rear heat exchanger 9*c*. During the passage, the air exchanges heat with, for example, a refrigerant in each of the front heat exchanger 9*b* and the rear heat exchanger 9*c*, thereby being cooled, heated, or dehumidified. Then, the flows of air that have passed through the front heat exchanger 9*b* and the rear heat exchanger 9*c* pass through the crossflow fan 7, are guided by the guide wall 7*c*, and are fed into the room 10 from the air outlet 3. When the air passes through the air outlet 3, the direction in which air flows is controlled by the air vanes 4.

In the floor-standing air-conditioning apparatus configured as described above, the crossflow fan 7 and the fan motor are positioned on the rear side in the depth direction with respect to the depth-direction center of the body. Thus, the air-conditioning-apparatus body 1 becomes less liable to fall frontwards (toward the front side). Also, the occurrence of vibrations during the operation can be suppressed to reduce noise generated by the vibrations transmitted into the room 10. Furthermore, since the heat exchanger 9 (the front heat exchanger 9*b* and the rear heat exchanger 9*c*) is arranged obliquely in the air-conditioning-apparatus body 1, the ratio of the heat exchange area to the height can be increased, whereby the heat exchange performance is increased. Consequently, energy can be saved. Furthermore, since the heat exchanger has a V shape and allows air to flow from the front side and from the rear side with respect to the drain pan 11 provided below the heat exchanger, the drift of air is suppressed. Furthermore, the distribution of the amount of air taken into the crossflow fan 7 (impeller 7*a*) can be uniformed to keep the noise level low, and reduce the torque of the fan motor. Furthermore, since the front panel 6 is a flat panel and has only a few (no) grating bars, dust and the like can easily be removed from the front panel 6, even if any such dirt adheres to it. Furthermore, since the inside of the air-conditioning-apparatus body 1 cannot be seen, properties of design can be improved. Furthermore, even if dew condensation occurs on the lower diffuser 3*a* in the lower portion of the air outlet 3, the dew water is prevented from dropping to the outside of the air-conditioning-apparatus body 1. Thus, the floor 10*a* is prevented from being contaminated and is kept with high quality. Since the air outlet 3 opens from the front face to the upper portion, the direction in which air flows can be smoothly controlled over the range from the floor surface to the ceiling. Thus, effects such as an even temperature distribution over the entire room 10 and a reduction in discomfort that humans feel when the air directly strikes their bodies are produced, increasing comfort. With the aforementioned arrangement, a low-noise, energy-saving, good-design, high-quality, highly comfortable, floor-standing air-conditioning apparatus can be provided.

In the air-conditioning apparatus according to Embodiment 1, the vertical distance F in the height direction of the air-conditioning-apparatus body 1 is equal to or smaller than the product of the fan outside diameter D multiplied by four, and the air inlet 2 includes the front air inlet 2*b* and the lower air inlet 2*a*. Hence, for example, air flows in from the front air inlet 2*b*, and there is no chance that air taken in from the lower air inlet 2*a* may rise to an area near the crossflow fan 7 at once and be abruptly taken into the crossflow fan 7. Air is also allowed to flow toward the rear heat exchanger 9*c* provided on the rear side with respect to the crossflow fan 7. Moreover, the air velocity distribution in the heat exchanger 9 can be uniformed to increase the heat exchange performance. Furthermore, since the amount of air that is blown for heat exchange is reduced, the power consumption of the fan motor can be reduced. Furthermore, since the flow rate of the refrigerant that is used for heat exchange can also be reduced, the power consumption of a compressor (not illustrated) that circulates the refrigerant through a refrigerant circuit is reduced. Thus, energy can be saved.

In the air-conditioning apparatus according to Embodiment 1, the front-panel opening 6*a* of the front panel 6 is provided within the area defined between the two horizontal tangent lines L1 and L2 that are tangent to the circle D1 defining the fan perimeter and represent the upper limit position and the lower limit position, respectively, in the height direction of the air-conditioning-apparatus body 1. Therefore, even if dust and the like accumulate on the filter 14 and the load increases, air can easily flow toward an area near the circular vortex and stabilizes the circular vortex. This can prevent the occurrence of a counterflow of taken air. Accordingly, in a cooling operation, for example, high-temperature air that is present in the room 10 does not flow reversely toward the crossflow fan 7, preventing the occurrence of dew condensation. This makes it possible to provide a high-quality, floor-standing air-conditioning apparatus.

The front air inlet 2*b* of the air-conditioning apparatus according to Embodiment 1 is provided with the air-guiding wall 6*b*. Therefore, for example, when seen from the front, from above in the installed state, or from any other like side of the air-conditioning apparatus, the inside of the air-conditioning-apparatus body 1 cannot be seen through the open portion. Thus, a good-design, floor-standing air-conditioning apparatus can be provided.

In the heat exchanger 9 according to Embodiment 1, the front heat exchanger 9*b* has a larger heat exchange area than the rear heat exchanger 9*c*. Since the heat exchange area of the front heat exchanger 9*b* provided on the side of the fan where the circular vortex occurs is larger than that of the rear heat exchanger 9*c*, the amount of air to be taken in is increased and the circular vortex is stabilized. Therefore, the behavior in the crossflow fan 7 is stabilized, and no abnormal sound is generated due to fluid factors. Furthermore, the flow of air passing below the front heat exchanger 9*b* is not pushed away by the flow of air from the rear heat exchanger 9*c*. Therefore, the air velocity distribution in the heat exchanger 9 can be uniformed to increase the heat exchange performance. Under such circumstances, since the flow rate of the refrigerant that is used for heat exchange can also be reduced to, in turn, reduce the power consumption of the compressor (not illustrated) that circulates the refrigerant through the refrigerant circuit. Thus, energy can be saved. This makes it possible to provide a high-quality, energy-saving, floor-standing air-conditioning apparatus in which the generation of an abnormal sound is suppressed.

In Embodiment 1, the upper end position 2*a*1 of the lower air inlet 2*a* is positioned below the drain-pan lower end 11*a* so that the heat exchanger 9 and the drain pan 11 cannot be seen through the lower air inlet 2*a*. This makes it possible to provide a good-design, floor-standing air-conditioning apparatus.

In Embodiment 1, the shortest distance C1 between the drain-pan front side wall 11*b* and the front panel 6 (the front air passage wall) and the shortest distance C2 between the drain-pan rear side wall 11*c* and the rear air passage wall 13 satisfy a relation C1>C2. Thus, the air passage on the front side can have a large area. Therefore, the taken air easily flows toward the front side, and the distribution of the amount of air taken into the crossflow fan 7 (impeller 7*a*) can be uniformed to keep the noise level low, and reduce the torque of the fan motor, whereby the power consumption is reduced. This makes it possible to provide a low-noise, energy-saving, floor-standing air-conditioning apparatus.

In Embodiment 1, the lower air inlet 2*a* opens to the lower face of the air-conditioning-apparatus body 1 so as to face the floor 10*a*, and the frames 1*f* are provided at the two respective ends of the air-conditioning-apparatus body 1 in front view of the air-conditioning-apparatus body 1. Therefore, dust and the like on the surface of the floor 10*a* is also taken in. Furthermore, when the air-conditioning apparatus is installed on the wall 10*b* near the floor 10*a*, air is also taken in from below. In such a case, since the area of the air inlet is increased so as to reduce the draft resistance, a low-noise, floor-standing air-conditioning apparatus can be provided.

In Embodiment 1, the downstream-side end 3*b* of the lower diffuser 3*a* at the air outlet 3 has the recess 3*c*. Therefore, even if dew condensation occurs on the lower diffuser 3*a*, the dew water can be retained in the recess 3*c*. Hence, the dew water can be prevented from being discharged to the outside, increasing the quality. Thus, a high-quality, floor-standing air-conditioning apparatus can be provided.

In Embodiment 1, the filter 14 includes the filters that are separate from each other and are provided in the respective air passages to the front heat exchanger 9*b* and to the rear heat exchanger 9*c*. The filter 14 on the side of the rear heat exchanger 9*c* is finer and has a higher collection efficiency than the filter 14 on the side of the front heat exchanger 9*b*. Thus, a high-quality, floor-standing air-conditioning apparatus configured to collect not only dust balls on the floor surface but also fine dirt and the like can be provided.

Furthermore, since the center of gravity of the air-conditioning-apparatus body 1 is defined at least near the center of the air-conditioning apparatus in the depth direction, the air-conditioning apparatus can be installed and fixed by simply placing the air-conditioning apparatus on the floor 10*a*. For example, since the air-conditioning apparatus stands by itself even without being fixed to the wall 10*b* on the rear side thereof, the limitation for installation is eliminated, increasing the ease of installation. Moreover, vibrations that may occur during the operation can be reduced. Thus, an easy-to-construct, high-quality, floor-standing air-conditioning apparatus can be provided.

Embodiment 2

Figure 3:
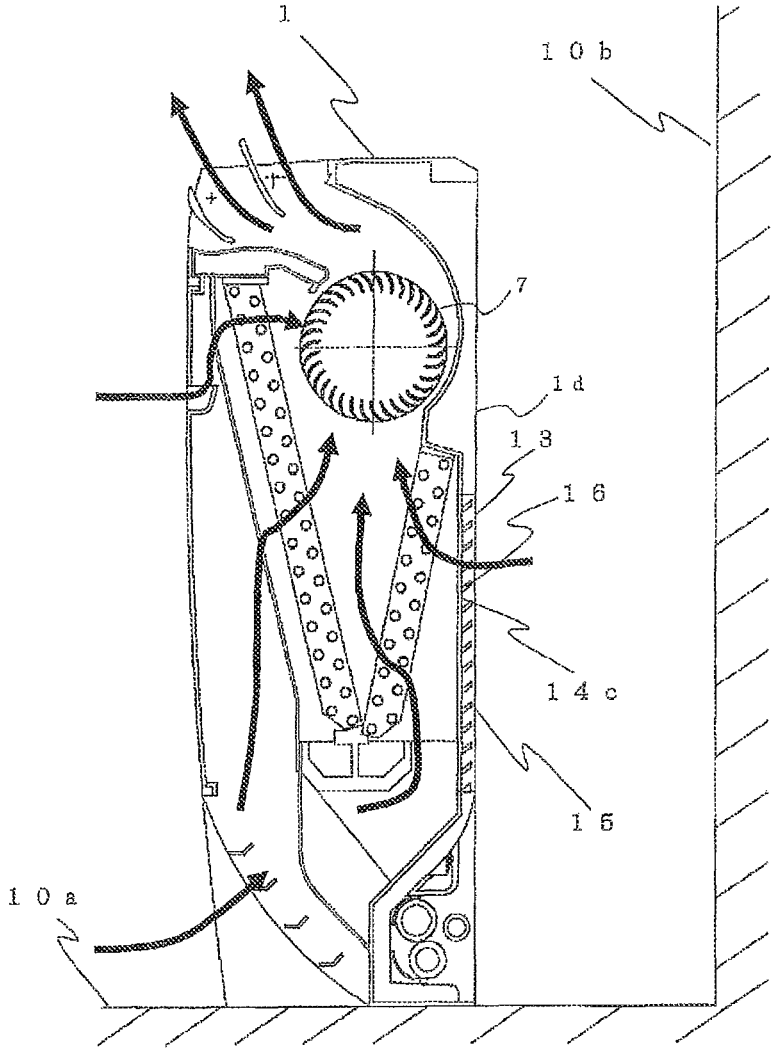
FIG. 3 is a vertical sectional view of an air-conditioning apparatus according to Embodiment 2 of the present invention.

FIG. 3 is a vertical sectional view of the body of an air-conditioning apparatus according to Embodiment 2 of the present invention in a vertical cross-section perpendicular to the rotational axis of a crossflow fan 7 and near the substantial center in the horizontal direction in front view. The air-conditioning apparatus according to Embodiment 2 includes a rear panel 15 on the side of a body rear face 1*d*, instead of the rear attaching plate 5 provided to be fixed to the wall 10*b* in Embodiment 1. The rear panel 15 has a detachable rear-panel filter 14*c* and a rear air-inlet opening 16. For example, if the air-conditioning-apparatus body 1 is simply placed on the floor 10*a* with a gap from the wall 10*b*, air is allowed to flow in from the rear air-inlet opening 16 of the rear panel 15. Thus, the heat exchange performance is increased to save energy.

Even when the air-conditioning apparatus is attached to the wall 10*b* as in Embodiment 1, if the rear air passage wall 13 is closed with the rear panel 15 being attached to the air-conditioning-apparatus body 1, the same installation as in Embodiment 1 is realized. Thus, the limitations for installation are reduced. This makes it possible to provide an energy-saving, easy-to-construct, floor-standing air-conditioning apparatus.

INDUSTRIAL APPLICABILITY

As an application of the air-conditioning apparatus according to the present invention, a floor-standing air-conditioning apparatus is provided in which an air-conditioning-apparatus body 1 has a rectangular parallelepiped shape that is horizontally elongated in front view and is placed on a floor surface or on a wall near the floor surface; the fan is a crossflow fan extending in the horizontal direction in which the air-conditioning-apparatus body is elongated; and at least the air outlet, the fan, and the fan motor are provided in an upper portion of the air-conditioning-apparatus body in the height direction. In such an air-conditioning apparatus, a large-capacity heat exchanger can be provided without increasing the size of the body. Furthermore, the draft resistance in the air passage is reduced, and the air passage has such a shape as to stabilize the operation of the fan. Thus, an energy-saving, silent, highly comfortable, easy-to-construct, high-quality, floor-standing air-conditioning apparatus is provided.

REFERENCE SIGNS LIST air-conditioning-apparatus body 1*a* body front face 1*b* body side face 1*c* body upper face 1*d* body rear face 1*e* body lower face 1*f* body frame 2*a* lower air inlet 2*a*1 upper end position of lower air inlet 2*a* 2*b* front air inlet 3 air outlet 3*a* lower diffuser 3*b* downstream-side end 3*c* recess 4 air vane 5 rear attaching plate 6 front panel 6*a* front-panel opening 6*b* air-guiding wall 7 crossflow fan 7*a* impeller 7*b* stabilizer 7*c* guide wall 7*d* ring 7*e* blade 9 heat exchanger 9*a* V-shaped projection 9*b* front heat exchanger 9*c* rear heat exchanger 9*d* lower end of heat exchanger 10 room 10*a* floor 10*b* wall 11 drain pan 11*a* drain-pan lower end 11*b* drain-pan front side wall 11*c* drain-pan rear side wall 12*a* front air passage opening 12*b* rear air passage opening 13 rear air passage wall surface 14 filter 14*a* front-heat-exchanger-side filter 14*b* rear-heat-exchanger-side filter 14*c* rear-panel filter 15 rear panel 16 rear air-inlet opening 17 outdoor-unit-connection-pipe-storing space A direction of fan rotation C1 shortest distance between drain-pan front side wall 11*a* and front panel 6 C2 shortest distance between drain-pan rear side wall 11*c* and rear air passage wall 13 D fan outside diameter D1 circle defining fan perimeter E1 inlet-side air passage E2 outlet-side air passage F vertical distance between fan axis of rotation center O and lower end 9*d* of heat exchanger 9 H air-conditioning-apparatus height L1, L2 two horizontal tangent lines tangent to circle D1 defining fan perimeter O fan axis of rotation center.

The invention claimed is:

1. A floor-standing air-conditioning apparatus comprising:

a lower air inlet having an air inlet opening configured to allow air to flow into a body from a lower portion of the body on a side of a front face of the body;

an air outlet having an air outlet opening configured to allow air in the body to flow out of the body and rise upwardly;

a heat exchanger that is provided in the body and configured to condition air;

a crossflow fan that is provided in the body and configured to produce a flow of air in which the air that has flowed into the body passes through the heat exchanger and is guided to the air outlet; and a drain pan that is provided below the heat exchanger in a height direction of the body and configured to receive water generated by dew condensation, wherein:

the crossflow fan is provided at a position below the air outlet in the height direction of the body and on a side of rear face with respect to a center of the body in a depth direction, the heat exchanger includes a front heat exchanger provided on the side of the front face and a rear heat exchanger provided on the side of rear face, a pair of which form a V shape with their lower ends being in contact with or in proximity to each other, and are arranged so that the crossflow fan is positioned between the front heat exchanger and the rear heat exchanger, the body includes an arrangement that splits the air, having flown therein from the lower air inlet, into a front air passage provided on a front side with respect to a drain-pan front side wall of the drain pan and forming a passage of air flowing into the front heat exchanger, and a rear air passage provided on a rear side with respect to a drain-pan rear side wall of the drain pan and forming a passage of air flowing into the rear heat exchanger, and a shortest distance between the drain-pan front side wall and a front air passage wall surface of the body is larger than a shortest distance between the drain-pan rear side wall and a rear air passage wall surface of the body.

2. The floor-standing air-conditioning apparatus of claim 1, further comprising:

a front air inlet provided in a front panel configured to cover the front face of the body and between the lower air inlet and the air outlet, the front air inlet including an opening configured to allow air to flow into the body, wherein a distance in the height direction of the body between a center of a rotational axis of the crossflow fan and the lower end of the heat exchanger is not more than a product of an outside diameter of the crossflow fan multiplied by four.

3. The floor-standing air-conditioning apparatus of claim 2, wherein the opening of the front air inlet is positioned in the height direction of the body to fall within a range between an upper end and a lower end of a circle defining a perimeter of the crossflow fan.

4. The floor-standing air-conditioning apparatus of claim 2, wherein the front air inlet further includes an air-guiding wall that extends from a lower portion of the opening substantially horizontally into the body, then curves upward, and further extends upward while facing a wall surface of the front panel.

5. The floor-standing air-conditioning apparatus of claim 2, wherein the front panel comprises a flat panel.

6. The floor-standing air-conditioning apparatus of claim 1, wherein an area of the front heat exchanger through which the air passes is larger than an area of the rear heat exchanger through which the air passes.

7. The floor-standing air-conditioning apparatus of claim 1, wherein an upper end position of the lower air inlet is lower in level in the height direction of the body than a lower end of the drain pan.

8. The floor-standing air-conditioning apparatus of claim 1, further comprising a rear panel provided on a rear side wall of the body that is on an upstream side of the crossflow fan, the rear panel having a detachable filter and an air inlet opening.

9. The floor-standing air-conditioning apparatus of claim 1, wherein the opening of the lower air inlet opens to a lower face of the body, and the floor-standing air-conditioning apparatus further comprises frames individually provided in lower portions of right and left side faces of the body so as to form an arch shape and to support the body.

10. The floor-standing air-conditioning apparatus of claim 1 further comprising:

a lower diffuser having a recess at an end on a downstream side in a direction in which the air flows.

11. The floor-standing air-conditioning apparatus of claim 1, further comprising:

a front filter that collect dust in air flowing from the lower air inlet into the front heat exchanger; and a rear filter that is finer and is higher in collection efficiency than the front filter, the rear filter collecting dust in air flowing from the lower air inlet into the rear heat exchanger.

12. The floor-standing air-conditioning apparatus of claim 1, wherein the heat exchanger, the crossflow fan, and the drain pan are arranged such that a center of gravity of the floor-standing air-conditioning apparatus is positioned at a substantial center in a depth direction.

* * * * *